US005782030A

United States Patent [19]

French

[11] Patent Number: 5,782,030

[45] Date of Patent: Jul. 21, 1998

[54] BARREL FOR MUZZLE LOADING FIREARM

[75] Inventor: Kendrick L. French, Lebanon, Me.

[73] Assignee: Thompson Intellectual Properties, Inc., Rochester, N.H.

[21] Appl. No.: 815,393

[22] Filed: Mar. 11, 1997

Related U.S. Application Data

[62] Division of Ser. No. 575,207, Dec. 19, 1995, Pat. No. 5,639,981.

[51] Int. Cl.[6] ..... F41A 21/00

[52] U.S. Cl. ..... 42/76.01; 42/78

[58] Field of Search ..... 42/76.01, 78; 89/14.05; 408/201; 29/1.1, 1.11

[56] References Cited

U.S. PATENT DOCUMENTS

| | | | |
|---|---|---|---|
| 3,115 | 6/1843 | Newton . | |
| 315,746 | 4/1885 | De Arguibel . | |
| 1,724,005 | 8/1929 | Christensen | 89/14.05 |
| 2,104,319 | 1/1938 | Dicke | 29/1.1 |
| 2,293,114 | 8/1942 | Cater | 29/1.1 |
| 3,525,172 | 8/1970 | Marshall et al. . | |
| 4,008,538 | 2/1977 | Center | 42/78 |
| 4,126,955 | 11/1978 | Coffield, Jr. et al. . | |
| 4,527,348 | 7/1985 | Brennan . | |
| 4,570,529 | 2/1986 | A'Costa | 89/14.2 |
| 4,660,312 | 4/1987 | A'Costa | 42/76.01 |
| 5,155,291 | 10/1992 | Dabrowski | 408/201 |
| 5,435,089 | 7/1995 | Rodney, Jr. | 42/51 |
| 5,565,642 | 10/1996 | Heitz | 89/7 |
| 5,623,780 | 4/1997 | Phillips, Jr. | 42/76.01 |
| 5,639,981 | 6/1997 | French | 89/1.3 |

FOREIGN PATENT DOCUMENTS 143403 8/1950 Australia .

OTHER PUBLICATIONS

"The Muzzle-Loading Cap Lock Rifle", by Ned H. Roberts, originally published by The Granite State Press (1940); reproduced by Wolfe Publishing Co. (1991).

Encyclopedia of Firearms, Edited by Harold L. Peterson, Published 1964, pp. 126–127.

Flayderman's Guide to Antique American Firearms and Their Values, 6th Edition 1994, Norm Flayderman, p. 557.

Gun Digest—Black Powder Loading Manual—Revised and Expanded Edition, Sam Fadala, MCMXCI–1991, p. 73.

*Primary Examiner*—Charles T. Jordan
*Assistant Examiner*—Meena Chelliah
*Attorney, Agent, or Firm*—Blodgett & Blodgett, P.C.

[57] ABSTRACT

A barrel for a muzzle loading firearm. The inner cylindrical surface which defines the bore of the barrel has a main portion which is provided with rifling and a muzzle portion which is integral with the main portion which extends from the main portion to the muzzle opening. The muzzle portion of the inner cylindrical surface has a diameter which is less than the inner diameter of the main portion of the inner cylindrical surface. The barrel of the present invention is made by drilling a cylindrical bore along a longitudinal axis of a solid barrel stock and forming rifling along the inner cylindrical surface which defines the bore with the use of a traditional rifling tool. A counterboring tool is then inserted to the muzzle opening to enlarge the muzzle end of the bore to form the muzzle portion of the inner cylindrical surface.

8 Claims, 2 Drawing Sheets

BARREL FOR MUZZLE LOADING FIREARM

This application is a divisional of application Ser. No. 08/575,207, filed Dec. 19, 1995, U.S. Pat. No. 5,639,981.

BACKGROUND OF THE INVENTION

The present invention is directed to an improved barrel construction for a muzzle loading firearm and a method of forming the barrel.

Most modern muzzle loading firearms are provided with rifling along the inner cylindrical surface which defines the bore of the barrel. The rifling improves shooting accuracy, particularly when the firearm is utilized with bullet shaped projectiles. The rifling consists of a plurality of spaced grooves which extend helically along the length of the barrel. The areas between the grooves are defined as lands. The lands also extend helically along the length of the barrel. In order for the rifling to be effective in imparting spin to the projectile, the outer diameter of the projectile is slightly larger that the inner diameter of the lands of the inner surface of the barrel and slightly smaller than the inner diameter of the grooves of the inner surface of the barrel.

When the projectile is inserted into the bore of the barrel, the lands of the rifling impress into the projectile. Therefore, considerable force is required to advance the projectile along the bore. The projectile is caused to rotate about its longitudinal axis as it is advanced along the bore from the muzzle. This makes the projectile loading step quite difficult, particularly at the muzzle end of the barrel. A traditional ramrod is too awkward to be used for the initial projectile inserting step (starting). A short ramrod known as a "short starter" is used to force the projectile into the barrel for a short distance. A traditional ramrod is then used to push the projectile to its final firing position. A special starting tool can also used to introduce the projectile into the muzzle of the firearm. The starting tool includes a body which has a socket for receiving the projectile, nose first. A handle is connected to the body by an auger. The auger is threaded into the body to the socket for engaging the projectile. The base of the projectile extends beyond the socket and is axially aligned with the muzzle of the firearm. The handle of the started is pushed toward the muzzle This causes the auger to push the projectile out of the socket and into the muzzle. Because of the difficulty of "starting" the projectile, it is difficult to control the axial alignment of the projectile within the bore regardless of what type of tool is used A slight axial misalignment of the projectile within the bore has a negative effect on the shooting accuracy of the firearm. The step of forcing the projectile into the muzzle also causes excessive wear and damage to the muzzle end of the barrel. Additional wear to the rifling at the muzzle end of the barrel also occurs as a result of cleaning operations.

Attempts have been made by some shooters to overcome the problems associated with the use of rifling enhanced muzzle loading firearms. One such attempt comprises cutting off a short portion of the end of the barrel and enlarging the bore of the cut-off portion of the barrel. Prior to removal of the end portion of the barrel, small holes are drilled in the barrel. The holes are parallel to the longitudinal axis of the barrel. The holes extend beyond the portion of the barrel which is be cut-off- This enables locating pins to be inserted into the holes to enable the cut-off portion of the barrel to be temporarily reunited with the main portion of the barrel. This insures that the cut-off portion of the barrel will be returned to its original position so that the bore of the cut-off portion of the barrel is aligned with the bore of the main portion of the barrel. The cut-off portion of the barrel receives the projectile quite freely and enables the projectile to be loaded more easily into the main portion of the barrel. The short portion of the barrel is then removed prior to firing of the firearm. This solution to the problem of projectile loading has not been widely employed. Very few sportsmen have the means or the skills required for such a procedure. Although the cut-off barrel portion can be returned to its original position on the barrel, there is no guarantee that the axis of the enlarged bore of the cut-off barrel portion will be concentric with the axis of the bore of the main portion of the barrel. The application and removal of the cut-off portion of the barrel adds two extra steps in the loading sequence. The length of the barrel is effectively shortened which has a negative effect on the balance and shooting accuracy of the firearm. Some muzzle loading rifles are sold with a "false muzzle". A "false muzzle" is a device produced by making the barrel several inches longer than intended for shooting during its manufacture. After providing rifling in the bore of the barrel the end of the barrel is cut-off. The cut-off portion of the barrel is then referred to as the "false muzzle". The "false muzzle" is then provided with locating pins which fit into corresponding holes in the muzzle end of the barrel to insure alignment of the rifling between the barrel proper and the "false muzzle". The initial loading of the projectile occurs in the "false muzzle" apart from the firearm. The "false muzzle" is then attached to the muzzle end of the firearm to complete the projectile loading process. Since the "false muzzle" takes the majority of the wear in the loading and cleaning processes, the life of the firearm is lengthened and its accuracy is preserved. However, the initial starting step for the projectile is still difficult even with the "false muzzle" and the problem of misalignment of the projectile relative to the bore of the barrel is not eliminated. Also, since the "false muzzle" is a functional part of the original firearm, the value of the firearm is significantly diminished if the "false muzzle" is lost. The "false muzzle" cannot be replaced since it was an integral part of the barrel during the bore drilling and rifling processes. A variation of the "false muzzle" concept includes a device which is made as described above and which the bore of the "false muzzle" from the loading face of the "false muzzle". This enables the projectile to be inserted into the bore of the "false muzzle" by finger pressure. All false muzzles must be removed from the barrel before firing of the firearm and reapplied before reloading of the firearm. These two extra steps greatly increase the time required for each loading and firing operation. These and other difficulties experienced with the prior art rifled barrels for muzzle loading firearms have been obviated by the present invention.

It is, therefore, a principle object of the invention to provide a rifled barrel for a muzzle loading firearm which greatly facilitates the step of loading of the projectile into the bore of the barrel.

Another object of the invention is the provision of a rifled barrel for a muzzle loading firearm which provides for more accurate centering of the projectile in the barrel, thereby resulting in greater firing accuracy for the firearm.

A further object of the present invention is the provision of a rifled barrel for a muzzle loading firearm which does not require the need for a short starter to initiate the loading step of a projectile into the bore of the barrel.

It is another object of the present invention to provide a method of forming a barrel for muzzle loading firearm which results in a barrel that is easier to projectile load and does not require a short starter to initiate projectile loading of the projectile, and which improves the accuracy of the firearm by providing for more accurate axial alignment of the projectile within the bore of the barrel.

A still further object of the invention is the provision of a method of forming a rifled barrel for a muzzle loading firearm and the barrel which is produced thereby for enabling a projectile to be loaded process easily, quickly, and more accurately so that overall loading takes substantially less time and shooting accuracy is significantly improved.

It is a further object of the invention to provide a counterboring tool for enlarging the bore at the muzzle end of a muzzle loading firearm.

With these and other objects in view, as will be apparent to those skilled in the art, invention resides in the combination of parts set forth in the specification and covered by the claims appended hereto.

SUMMARY OF THE INVENTION

In general, the invention consists of a barrel for a muzzle loading firearm The inner cylindrical surface which defines the bore of the barrel has a main portion which is provided with rifling and a muzzle portion which is integral with the main portion which extends from the main portion to the muzzle opening. The muzzle portion of the inner cylindrical surface has a diameter which is larger than the inner diameter of the main portion of the inner cylindrical surface. The preferred effective length of the muzzle portion is from ⅜ to 1". The barrel of the present invention is made by drilling a cylindrical bore along a longitudinal axis of a solid barrel stock and forming rifling along the inner cylindrical surface which defines the bore with the use of a traditional rifling tool. A counterboring tool is then inserted to the muzzle opening to enlarge the muzzle end of the bore to form the muzzle portion of the inner cylindrical surface. Ideally, the muzzle portion of the inner cylindrical surface is smooth and has an inner diameter which is preferably larger than the inner diameter of the main portion of the inner cylindrical surface at the groove portion of the rifling. More specifically, a transition section is formed between the muzzle portion and the main portion of the inner cylindrical surface which gradually decreases in diameter from the muzzle portion to the main portion.

BRIEF DESCRIPTION OF THE DRAWINGS

The character of the invention, however, may be best understood by reference to one of its structural forms, as illustrated by the accompanying drawings, and which.

DESCRIPTION OF THE PREFERRED EMBODIMENT

Figure 1:
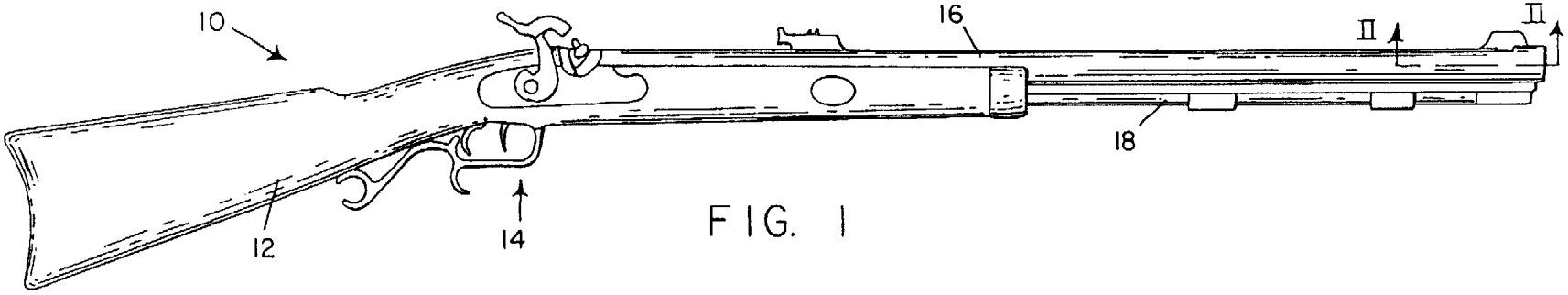
FIG. 1 is a side elevational view of a muzzle loading firearm embodying the principles of the present invention.
Figure 3:
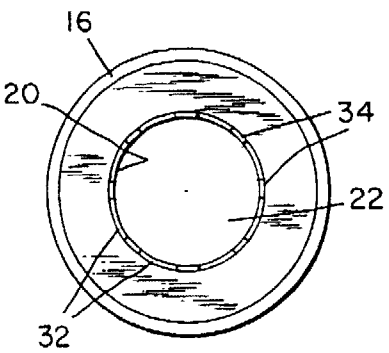
FIG. 3 is a front elevational view of the muzzle end of the barrel.
Figure 2:
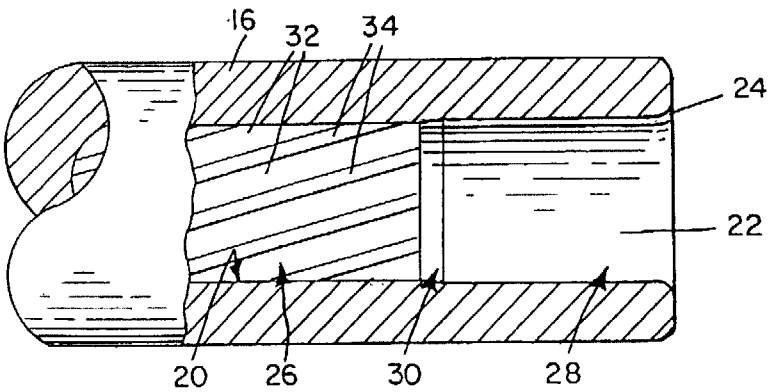
FIG. 2 is a horizontal cross-sectional view of the muzzle end of the barrel taken along the line II—II of FIG. 1 and looking in the direction of the arrows.

Referring to FIGS. 1–3, the muzzle loading firearm of the present invention is generally indicated by the reference numeral 10 and comprises a stock 12, a firing mechanism, generally indicated by the reference numeral 14, a barrel 16 and a ramrod 18.

The barrel 16 has an inner cylindrical surface, generally indicated by the reference numeral 20. The surface 20 defines a longitudinal bore 22 which has a muzzle opening 24. The inner cylindrical surface 20 has a main portion, generally indicated by the reference numeral 26, a muzzle portion, generally indicated by the reference numeral 28, and a transition portion, generally indicated by the reference numeral 30. The transition portion 30 is located between the main portion 26 and the muzzle portion 28. The main portion 26 extends from the transition portion 30 to the firing mechanism 14. The muzzle portion 28 extends from the transition portion 30 to the muzzle opening 24. The main portion 26 is provided with rifling which consists of a plurality of spaced grooves 32 which are separated by lands 34. The grooves 32 and the lands 34 extend helically along the main portion 26 of the inner cylindrical surface 20. The inner diameter of the muzzle portion 28 of the inner cylindrical surface is slightly larger than the inner diameter of the main portion 26 of the inner cylindrical surface at the grooves 32. The inner diameter of the transition portion 30 decreases gradually from the muzzle portion 28 toward the main portion 26 from that of the inner diameter of the muzzle portion 28 to that of the inner diameter of the main portion 26 at the grooves 32. The inner diameter of the main portion 26 at the grooves 32 is slightly smaller than the outer diameter of the projectile or bullet which is to be fired by the firearm 10. The inner diameter of the muzzle portion 28 is slightly larger than the outer diameter of the projectile which is to be fired by the firearm 10. This enables the projectile to be inserted into the muzzle portion 28 in a slip fit while maintaining the projectile axially aligned with the central longitudinal axis of the bore 22. This enables the projectile to be fully loaded into the bore 22 quickly and easily. Since the projectile is axially aligned within the muzzle portion 28, this alignment is maintained as the projectile is advanced along the main portion 26 toward the firing mechanism 14. As the projectile is pushed toward the firing mechanism 14, the lands 34 impress into the outer surface of the projectile and causes the projectile to rotate as the projectile is pushed along the length of the barrel 16 in a manner which is normally associated with the loading of a projectile into a muzzle loading firearm which is provided with rifling.

The following dimensions are given as an example for a 50 caliber firearm embodying the principle of the present invention:

Outer diameter of projectile=0.504"–0.506"

inner diameter bore at the grooves=0.509"–0.512"

Inner diameter of bore at the lands=0.500"–0.502"

Inner diameter muzzle portion of the bore=0.514"

Figure 4:
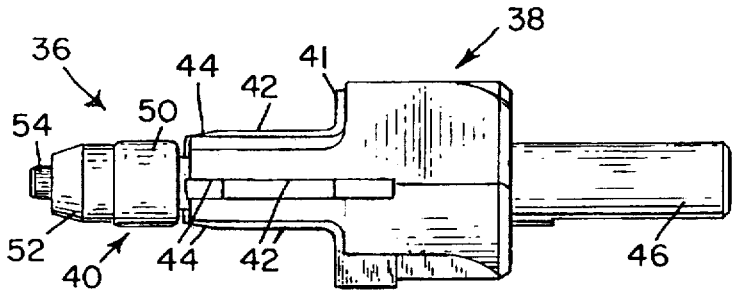
FIG. 4 is a side elevational view of a counterboring tool performing the muzzle portion of the bore.
Figure 5:
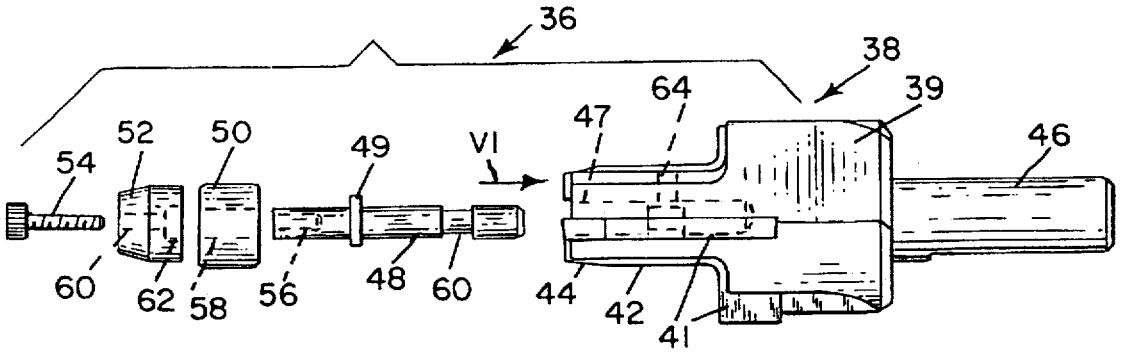
FIG. 5 is an exploded view of the counterboring tool.
Figure 6:
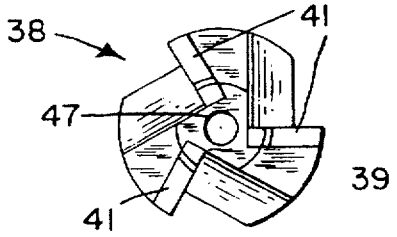
FIG. 6 is an end view of the cutter portion of the counterboring tool and looking in the direction of arrow VI of FIG. 5.

Referring to FIGS. 4–6, there is illustrated a counterboring tool, generally indicated by the reference numeral 36, for forming the muzzle portion 28 and the transition portion 30 of the inner cylindrical surface of the bore 22. The counterboring tool 36 comprises a cutting portion, generally indicated by the reference numeral 38, and a pilot portion, generally indicated by the reference numeral 40. The cutting portion 38 has a main body portion 39 for supporting a plurality of carbide cutting blades 41 and a shank 46 for insertion into a drill chuck. Each carbide cutting blade 41 has a main cutting edge portion which extends parallel to the longitudinal axis of a counterboring tool 36 and bevelled edge portion 44. The main cutting edge portion 42 is designed for counterboring the muzzle portion 28 and the bevelled edge portion 44 is designed for counterboring the transition portion 30. The forward end of the body portion 39 has a bore 47 which extends along the central longitudinal axis of the cutting portion 38.

The pilot portion 40 of the counterboring tool 36 comprises a spindle 48, a guide washer 50, a lead cap 52, and a screw 54. The rearward portion of the spindle 48 is adapted to be inserted into the bore 47. The forward portion of the spindle 48 has a threaded bore 56 for receiving the screw 54. The guide washer 50 has a smooth bore 58 for receiving the forward end of the spindle 48 so that the guide washer 50 is able to rotate freely on the forward end of the spindle. The lead cap 52 has a bore 60 and a counterbore 62. Which is coaxial with the bore 60. The pilot portion 40 is assembled by extending the forward end of the spindle 48 through the bore 58 of the guide washer 50 and into the counterbore 62 of the lead cap 52. The screw 54 is inserted through the bore 60 of the lead cap 52 and is threaded into the bore 56 to secure the lead cap 52 to the spindle 48 and to trap the guide washer 50 between the end cap 52 and a flange 49 of the spindle 48. The outer diameter of the washer 50 for a particular firearm caliber has an outer diameter which is slightly less than the inner diameter of the bore of the firearm. After the counterboring tool 36 has been assembled as described above, the rearward end of the spindle 48 is inserted into the bore 47 of the cutting portion 38 and held in place by a set screw 64. The rearward end of the spindle 48 has an annular groove 60 for this purpose.

I claim:

1. A method of making a barrel for a muzzle loading firearm comprising the following steps:

(a) drilling a longitudinal cylindrical bore into a solid length of metallic barrel stock from one end of the barrel stock so that a muzzle opening to the bore is formed at said one end, said longitudinal cylindrical bore being defined by an inner cylindrical surface;

b) forming rifling on the inner cylindrical surface of said barrel from said muzzle opening along substantially the entire length of said bore, said rifling comprising a plurality of spaced grooves which extend helically along the length of the inner cylindrical surface; and (c) enlarging the inner diameter of said cylindrical bore from said muzzle opening for a distance of at least ⅜" from said muzzle opening, the enlarged portion of said cylindrical bore being defined as a muzzle portion and the remainder of said cylindrical bore being defined as a main portion, the diameter of said muzzle portion being greater than the diameter of said main portion at the grooves.

2. A method of making a barrel as recited in claim 1, wherein the length of said muzzle portion is from ⅜" to 1".

3. A method of making a barrel as recited in claim 1, wherein the inner portion of said muzzle portion is smooth.

4. A method of making a barrel as recited in claim, 1 wherein the muzzle portion of said cylindrical bore is enlarged by using a counterboring tool which has a cutting portion for cutting into the inner cylindrical surface of the bore and a pilot portion for extending freely into said bore for guiding the cutting portion of the counterboring tool.

5. A method of making a barrel as recited in claim 1, further comprising the step of forming a transition portion of said cylindrical bore between said muzzle portion and said main portion, said transition portion having and inner diameter which gradually decreases from said muzzle portion to the grooves of said main portion.

6. A method of making a barrel for a muzzle loading firearm comprising the following steps:

(a) drilling a longitudinal cylindrical bore into a solid length of metallic barrel stock from one end of the barrel stock so that a muzzle opening to the bore is formed at said one end, said longitudinal cylindrical bore being defined by an inner cylindrical surface;

(b) forming rifling on the inner cylindrical surface of said barrel from said muzzle opening along substantially the entire length of said bore, said rifling comprising a plurality of spaced grooves which extend helically along the length of the inner cylindrical surface;

(c) enlarging the inner diameter of said cylindrical bore from said muzzle opening for a distance of at least ⅜" from said muzzle opening, the enlarged portion of said cylindrical bore being defined as a muzzle portion and the remainder of said cylindrical bore being defined as a main portion;

(d) forming a transition portion of said cylindrical bore between said muzzle portion and said main portion, said transition portion having and inner diameter which gradually decreases from said muzzle portion to the grooves of said main portion.

7. A method of making a barrel as recited in claim 6, wherein the length of said muzzle portion is from ⅜" to 1".

8. A method of making a barrel as recited in claim 6, wherein the inner surface of said muzzle portion is smooth.

* * * * *